US006769951B2

(12) United States Patent
Collier

(10) Patent No.: US 6,769,951 B2
(45) Date of Patent: Aug. 3, 2004

(54) WIND-ACTUATED NOVELTY DEVICE

(76) Inventor: Delvon Collier, 439 River Chase Dr., Athens, GA (US) 30605

( * ) Notice: Subject to any disclaimer, the term of this patent is extended or adjusted under 35 U.S.C. 154(b) by 0 days.

(21) Appl. No.: 10/141,407

(22) Filed: May 8, 2002

(65) Prior Publication Data

US 2003/0092352 A1 May 15, 2003

Related U.S. Application Data

(63) Continuation-in-part of application No. 09/999,420, filed on Nov. 15, 2001, now abandoned.

(51) Int. Cl.[7] ..... B60R 13/00; G09F 17/00

(52) U.S. Cl. ..... 446/218; 446/242; 446/243; 40/495; 40/591; 428/31

(58) Field of Search ..... 116/28 R, 173, 116/46; 40/591, 592, 493, 495; 446/213, 217, 218, 242, 243, 236; 428/31

(56) References Cited

U.S. PATENT DOCUMENTS

| | | | | | |
|---|---|---|---|---|---|
| 1,155,263 | A | * | 9/1915 | Naito | 446/218 |
| 1,583,881 | A | * | 5/1926 | Heberling | 446/218 |
| 1,994,202 | A | * | 3/1935 | Sarsfield | 446/186 |
| 2,857,507 | A | | 10/1958 | Stec | |
| 3,392,481 | A | | 7/1968 | Lee | |
| 3,675,364 | A | * | 7/1972 | Halpern | 446/218 |
| 3,837,112 | A | * | 9/1974 | Peterson | 446/218 |
| 3,929,310 | A | | 12/1975 | Peham | |
| 3,974,369 | A | | 8/1976 | Chmela et al. | |
| 4,030,237 | A | | 6/1977 | Lewis | |
| 4,162,032 | A | | 7/1979 | Lockwood | |
| D253,776 | S | | 12/1979 | Molenaar | |
| D257,364 | S | | 10/1980 | Molenaar | |
| 4,568,303 | A | | 2/1986 | Brown | |
| 4,758,197 | A | | 7/1988 | Lee | |
| 4,794,025 | A | | 12/1988 | Yamanaka | |
| 4,850,798 | A | | 7/1989 | Bailey | |
| 4,872,387 | A | | 10/1989 | Melia | |
| 4,928,954 | A | | 5/1990 | Levine et al. | |
| 5,042,418 | A | | 8/1991 | Hoover et al. | |
| 5,083,963 | A | | 1/1992 | Lin | |
| 5,092,809 | A | | 3/1992 | Kessler | |
| 5,115,756 | A | | 5/1992 | Maffei | |
| D331,785 | S | | 12/1992 | Mast | |
| 5,182,146 | A | | 1/1993 | O'Hara | |
| 5,233,938 | A | | 8/1993 | Lalo | |
| 5,315,492 | A | | 5/1994 | Davenport | |
| 5,320,061 | A | | 6/1994 | Laughlin et al. | |
| 5,368,515 | A | | 11/1994 | Mast | |
| 5,549,939 | A | | 8/1996 | Ray | |
| 5,588,897 | A | | 12/1996 | Valentino | |
| 5,659,988 | A | | 8/1997 | Kim et al. | |
| 5,665,438 | A | | 9/1997 | Lee et al. | |
| 5,749,765 | A | | 5/1998 | Stopperan | |
| 5,786,046 | A | * | 7/1998 | Ott | 428/31 |
| 5,836,800 | A | | 11/1998 | Liu | |
| 6,010,107 | A | | 1/2000 | Goldfarb | |
| D421,238 | S | | 2/2000 | Dinsky | |
| 6,083,076 | A | | 7/2000 | Saint-Victor | |
| 6,085,687 | A | | 7/2000 | Chester | |
| 6,106,912 | A | | 8/2000 | Balog | |
| 6,206,747 | B1 | | 3/2001 | Skwarek | |
| 6,250,003 | B1 | | 6/2001 | Phinney | |
| 6,278,408 | B1 | | 8/2001 | Segovia, Jr. | |
| 6,280,804 | B1 | | 8/2001 | Akridge | |
| 6,386,939 | B1 | * | 5/2002 | Wu et al. | 446/218 |

* cited by examiner

*Primary Examiner*—Jacob K. Ackun, Jr.
(74) *Attorney, Agent, or Firm*—Myers & Kaplan, LLC; Joel D. Myers, Esq.; Sandra M. Sovinski, Esq.

(57) ABSTRACT

A wind-actuated, spinning novelty device enabling a user to quickly, easily and interchangeably mount and transport a dual-head rotational device on a vehicle and to enjoy an active display along with coincident display of a selected logo, mascot depiction, design and/or vocal, thereby enabling a user to demonstrate patriotism, support for a sports team or to display any other personal interest capable of visual and/or audible expression by providing a dynamic showcase for individual interests and/or beliefs through the incorporation of effects such as, for exemplary purposes only, holographic images, reflective ornamentation, distinctive coloration, lights, insignias, licensed characters, other special visual effects and/or other notable styles or features.

9 Claims, 6 Drawing Sheets

WIND-ACTUATED NOVELTY DEVICE

CROSS-REFERENCE TO RELATED APPLICATIONS

To the full extent permitted by law, the present application claims priority to and the benefit as a continuation-in-part application to non-provisional patent application entitled "Wind-Actuated Novelty Device" filed on Nov. 15, 2001, having assigned Ser. No. 09/999,420 and now abandoned, wherein said application is incorporated herein by reference.

TECHNICAL FIELD

The present invention relates generally to wind-actuated novelty devices and, more specifically, to a mountable, spinning novelty display device. The present invention is particularly useful wherein, although not strictly limited to, an individual desires to mount and transport a pinwheel-type display device on a vehicle, wherein the rotational display device is quickly, easily and removably secured to a vehicle window, enabling a user to enjoy an active display of a selected logo, design and/or vocal.

BACKGROUND OF THE INVENTION

Most individuals enjoy expressing their support for popular sports teams, collegiate affiliations, political candidates and/or personal interests or beliefs. Vehicle displays can be an effective means of such expression, since road trips typically provide encounters with numerous cars and trucks and the passengers riding therein. In fact, many individuals utilize their vehicle as a forum by affixing specialty bumper stickers and decorative or personalized license plates.

However, some vehicle owners prefer to avoid affixing traditional decorative or display articles to the bumpers or other surfaces of their car or truck primarily because of the potential for damage to the finish of the vehicle and/or the relative permanence of such displays. Vanity license plates are also generally permanent, much like bumper stickers. Furthermore, each such permanent display can limit a vehicle owner to repeatedly expressing the same message or team support. Although magnetic signs that removably affix to vehicle doors have been designed, thereby allowing a user to interchange between a variety of fairly inexpensive displays, such signs are typically two-dimensional and are usually only visible from one side of a vehicle.

To provide a more noticeable display, removable flags are available in a variety of colors and designs, wherein a user can display support for a sports team in the morning and a political organization in the afternoon, simply by replacing the flag on a vehicle window frame. Such flags and windsocks can be eye-catching, but have become somewhat commonplace thus disadvantageously losing some appeal.

Therefore, it is readily apparent that there is a need for an easily noticeable wind-actuated novelty display device enabling a user to removably and securely mount and display a pinwheel-type device on a vehicle, wherein each display device can incorporate a variety of logos, specialty coloration effects, rotationally activated visual effects and/or sound effects, thus preventing the above-discussed disadvantages.

BRIEF SUMMARY OF THE INVENTION

Briefly described, in a preferred embodiment, the present invention overcomes the above-mentioned disadvantages and meets the recognized need for such a device by providing a vehicle-mountable, spinning novelty display device, wherein a user can quickly, easily and interchangeably mount and transport a wind-actuated rotational display incorporating a selected logo, mascot, design or vocal.

According to its major aspects and broadly stated, the present invention is a wind-actuated, rotational novelty display device enabling a user to demonstrate patriotism, support for a selected sports team or to display any other personal interest capable of visual and/or audible expression, wherein the present invention can be handheld, positioned on or in the ground, or removably secured to a moving or stationary vehicle to provide a dynamic showcase for individual interests or beliefs.

More specifically, the present invention is a dual head display member positioned on a support arm, wherein the support arm enables secure and removable placement and display of the spinning novelty device on a vehicle. The dual head rotational member is preferably a pair of generally flat, circular shaped disks, each with a plurality of air receiving and deflecting ports extending outwardly therefrom and defined therethrough, wherein air received and deflected through the ports results in rotational movement of each head. The rotational members of the dual head display member are opposingly positioned on the distal end of the support arm and are securely and rotationally retained thereon. The base of the support arm provides a mount or bracket for removably secure fastening to a vehicle window or doorframe. The dual head display member is aesthetically designed to provide a dynamic visual show and can incorporate many effects such as, for exemplary purposes only, holographic images, reflective ornamentation, distinctive coloration, lights, insignias, logos, mascot depictions, licensed characters, special visual effects and/or other notable styles or features. Wind-actuated audible effects may also be incorporated, wherein cheers, mascot vocals or musical tunes would accompany the visual display.

A feature and advantage of the present invention is its ability to provide a method for visually communicating personal interests or beliefs to others.

Another feature and advantage of the present invention is its ability to enable a user to quickly and easily change from one type of display to another.

Another feature and advantage of the present invention is its ability to provide a dynamic visual display.

Another feature and advantage of the present invention is its ability to provide an audible display in combination with a dynamic visual display.

Another feature and advantage of the present invention is its ability to provide two rotating disks, wherein each can carry a different logo or visual display.

Another feature and advantage of the present invention is its ability to provide two rotating disks, wherein the dual rotation can enable the creation of specialized visual effects.

Another feature and advantage of the present invention is its ability to provide a wind-actuated novelty display, wherein visual and audible effects are wind-driven.

Another feature and advantage of the present invention is its ability to incorporate and display logos, mascot depictions, emblems and notable coloration to enhance visual display and to endorse a sports team, patriotic cause, product, holiday or any other targeted representation.

Another feature and advantage of the present invention is its ability to enable a handheld, vehicle mounted, or otherwise supported wind-actuated display device.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 2:
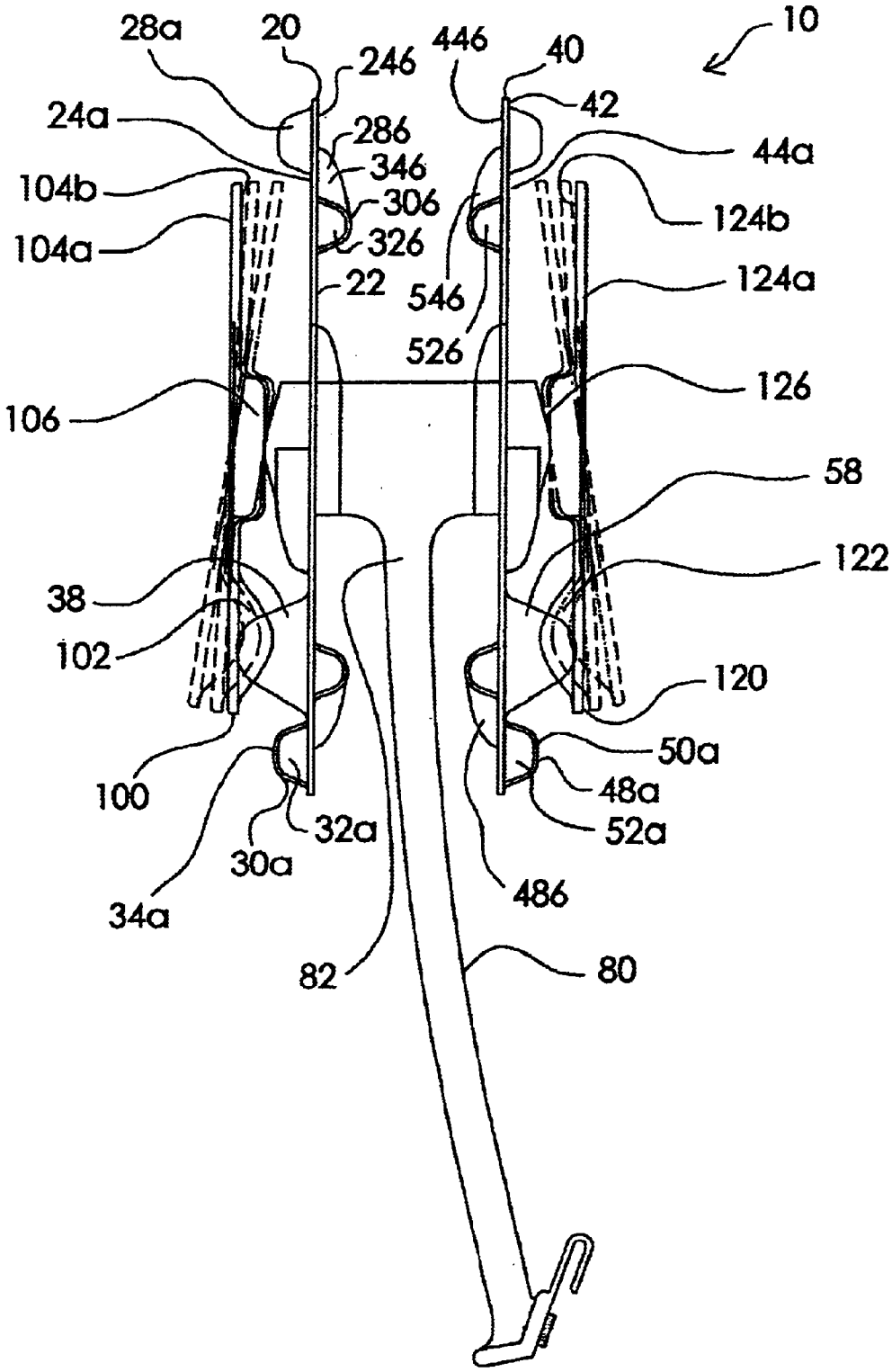
FIG. 2 is a side view of the wind-actuated novelty apparatus of FIG. 1, showing a preferred dual-head range of motion.

Referring now to FIG. 2, the present invention in its preferred form is a wind-actuated novelty device 10, generally comprising first rotational head 20, second rotational head 40, support member 80, first display head 100 and second display head 120. While other configurations could be utilized and are anticipated within the scope of the invention herein described, preferably first rotational head 20 and second rotational head 40 are opposingly positioned relative to support member 80.

Preferably, first rotational head 20 is generally flat, circular shaped disk 22, with first surface 24*a* and second surface 24*b*. Preferably, second rotational head 40 is generally flat, circular shaped disk 42, with first surface 44*a* and second surface 44*b*. While a generally flat, circular shape is preferred for first rotational head 20 and second rotational head 40, other shapes and surface styles are contemplated and could be utilized such as, for exemplary purposes only, a polygonal shape, a generally undulating or wavy shape, a pinwheel, floral shape or a generally freeform shape, some of which are more fully described herein.

Figure 1:
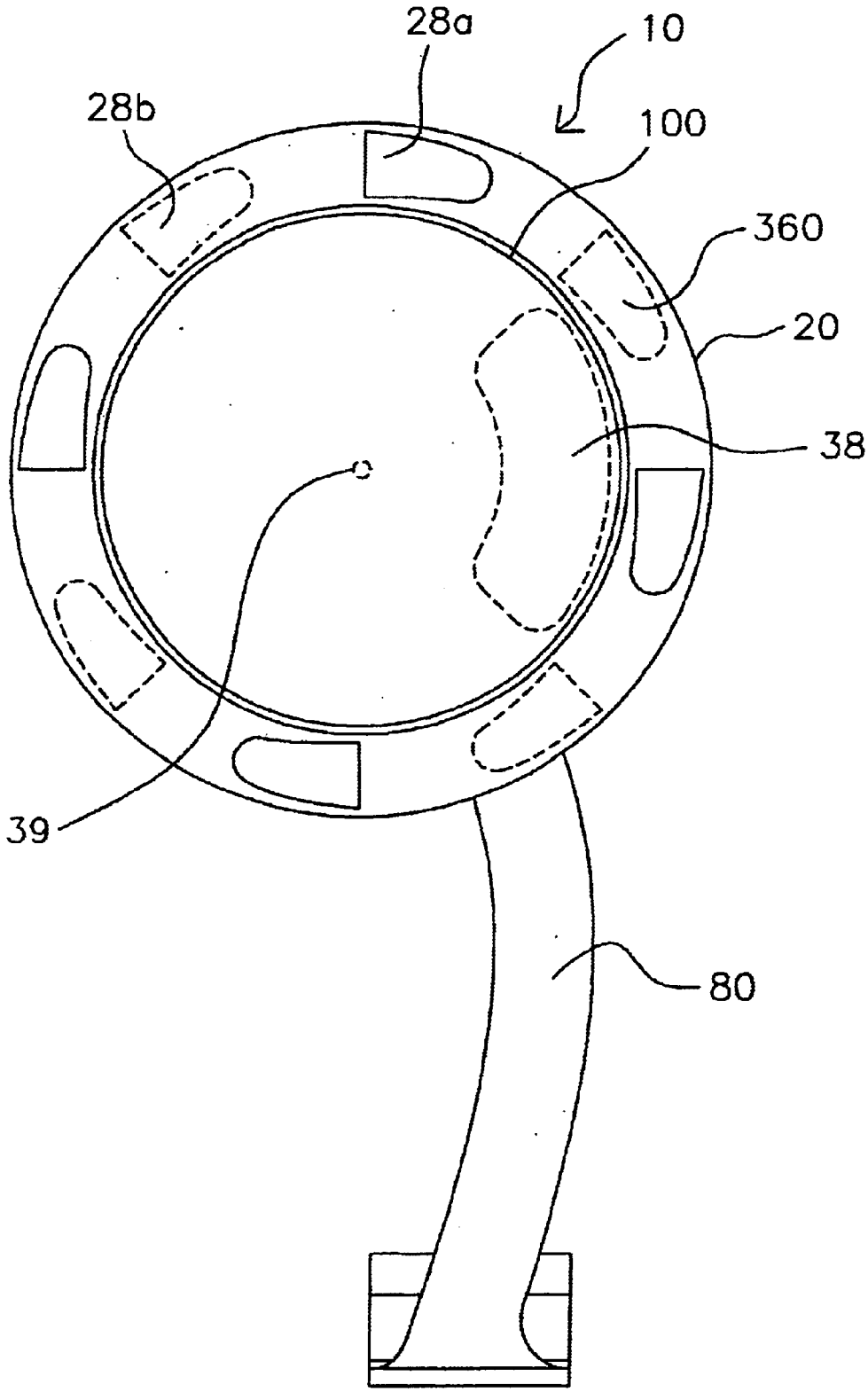
FIG. 1 is a plan view of a wind-actuated novelty apparatus according to a preferred embodiment of the present invention.

Preferably, a plurality of air receiving and deflecting ports 28*a* and 28*b* extend outwardly from first surface 24*a* and second surface 24*b* of first rotational head 20. Each port of plurality of ports 28*a* preferably defines a rounded, slightly triangular shape, wherein first arcuate edge 30*a,* together with first surface 24*a* of rotational head 20, defines air inlet 32*a*. Generally arcuate, triangular deflector 34*a* of each port of plurality of ports 28*a* is preferably secured to first surface 24*a* of first rotational head 20 via any securing means known within the art such as, for exemplary purposes only, epoxies, resins or integrally formed therewith, wherein air passing through air inlet 32*a* is directed by deflector 34*a* through port aperture 36*a* (see FIG. 1) to exit through second surface 24*b*.

Each port of plurality of ports 28*b* is preferably slightly triangular shaped, wherein first arcuate edge 30*b,* together with second surface 24*b* of first rotational head 20, defines air inlet 32*b*. Generally arcuate, triangular shaped deflector 34*b* of each port of plurality of ports 28*b* is preferably secured to second surface 24*b* of first rotational head 20 via any securing means known within the art such as, for exemplary purposes only, epoxies, resins or integrally formed therewith, wherein air passing through air inlet 32*b* is directed by deflector 34*b* through port aperture 36*b* (not shown) to exit through first surface 24*a*. Although one skilled in the art would readily recognize that deflectors 34*a* and 34*b* could be integrally formed with first rotational head 20 in lieu of being secured thereto, any other suitable forming or securing means could be utilized. Moreover, while a slightly triangular shape is preferred for deflectors 34*a* and 34*b,* other shapes could be utilized wherein the flow of air could pass thereagainst and therethrough. Preferably, the positioning of the plurality of ports 28*a* and 28*b* is alternating, wherein adjacent ports on first rotational head 20 receive, direct and deflect air from and in opposing directions, thereby generating rotational movement of first rotational head 20.

Preferably, a plurality of air receiving and deflecting ports 48*a* and 48*b* extend outwardly from first surface 44*a* and second surface 44*b* of second rotational head 40. Each port of plurality of ports 48*a* preferably defines a rounded, slightly triangular shape, wherein first arcuate edge 50*a,* together with first surface 44*a* of second rotational head 40, defines air inlet 52*a*. Generally arcuate, triangular deflector 54*a* of each port of plurality of ports 48*a* is preferably secured to first surface 44*a* of second rotational head 40 via any securing means known within the art such as, for exemplary purposes only, epoxies, resins or integrally formed therewith, wherein air passing through air inlet 52*a* is directed by deflector 54*a* through port aperture 56*a* to exit through second surface 44*b*.

Each port of plurality of ports 48*b* is preferably slightly triangular shaped, wherein first arcuate edge 50*b,* together with second surface 44*b* of second rotational head 40, defines air inlet 52*b*. Generally arcuate, triangular shaped deflector 54*b* of each port of plurality of ports 48*b* is preferably secured to second surface 44*b* of second rotational head 40 via any securing means known within the art such as, for exemplary purposes only, epoxies, resins or integrally formed therewith, wherein air passing through air inlet 52*b* is directed by deflector 54*b* through port aperture 56*b* to exit through first surface 44*a*. Although one skilled in the art would readily recognize that deflectors 54*a* and 54*b* could be integrally formed with second rotational head 40 in lieu of being secured thereto, any other suitable forming or securing means could be utilized. Moreover, while a slightly triangular shape is preferred for deflectors 54*a* and 54*b,* other shapes could be utilized wherein the flow of air could pass thereagainst and therethrough. Preferably, the positioning of the plurality of ports 48*a* and 48*b* is alternating, wherein adjacent ports on second rotational head 40 receive, direct and deflect air from and in opposing directions, thereby generating rotational movement of second rotational head 40.

Preferably, scoop cavities 38 and 58 are formed in first surface 24*a* and second surface 44*a,* respectively, of first rotational head 20 and second rotational head 40, respectively, wherein each scoop cavity 38 and 58 is generally arcuate and preferably follows the curvature of the diameter of first rotational head 20 and second rotational head 40, respectively. Preferably, the arcuate shape and curved surface of each scoop cavity 38 and 58 enables generally smooth interaction with each movement-generating member 102 and 122 of first display head 100 and second display head 120, respectively.

Preferably, first display head 100 and second display head 120 are generally circular-shaped with first surface 104*a* and 124*a,* respectively, and second surface 104*b* and 124*b,* respectively. Each first surface 104*a* and 124*a* is preferably substantially flat, wherein mount hardware receptacle 106 and 126, respectively, is preferably centrally defined therein. Each preferred substantially flat first surface 104*a* and 124*a* has a display (not shown) affixed thereto, wherein the display is preferably a hologram design, but may be any type of logo, emblem, licensed character or any other desirable display, and wherein the display is preferably affixed with adhesive, but may be affixed via any appropriate means such as, for exemplary purposes only, hook and loop fastener, magnets, snaps, interactive slots and/or screws.

Figure 3:
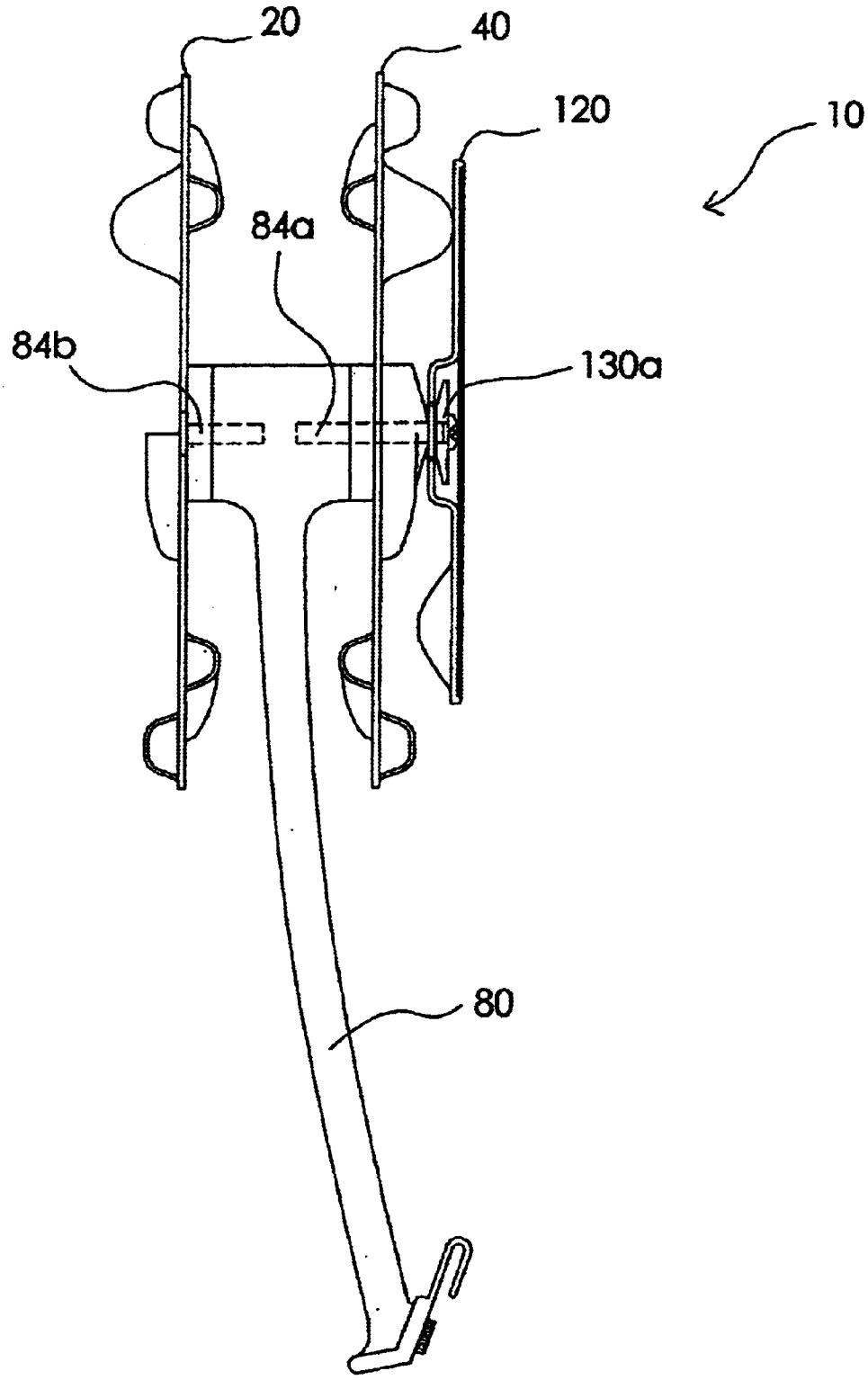
FIG. 3 is a cross-sectional side view of the wind-actuated novelty apparatus of FIG. 1, showing a preferred logo mount.
Figure 4:
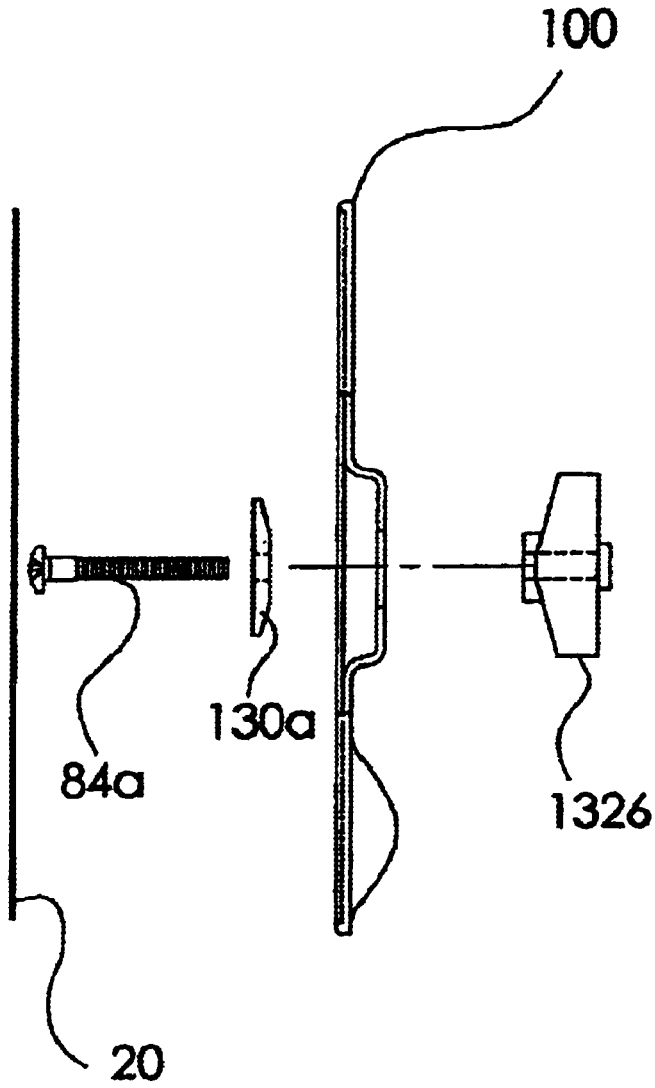
FIG. 4 is a partial exploded view of the wind-actuated novelty apparatus of FIG. 1, showing a preferred head mount.
Figure 5:
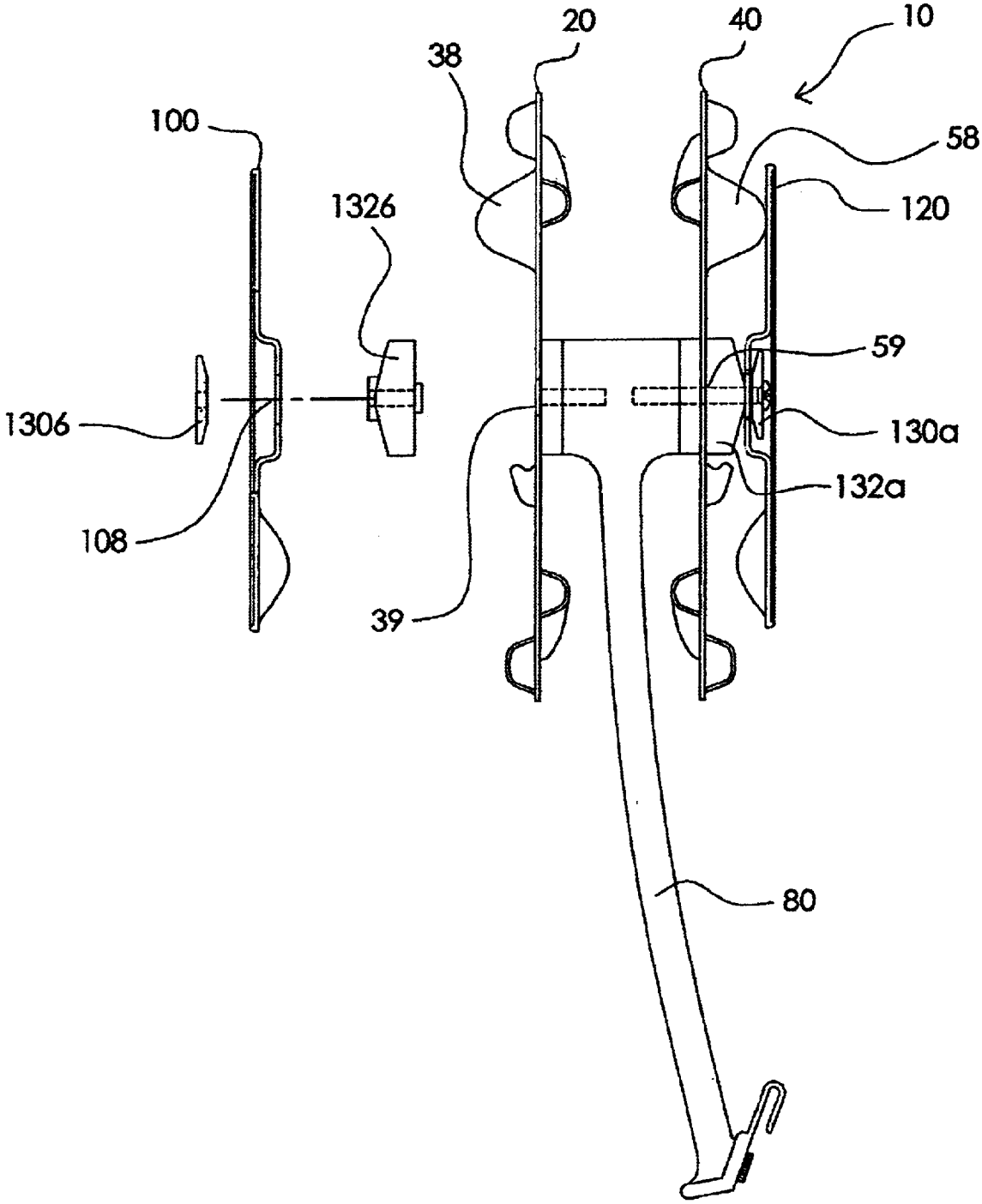
FIG. 5 is a partial exploded view of the wind-actuated novelty apparatus of FIG. 1, showing a preferred head mount configuration.

Preferably, first rotational head 20 and second rotational head 40 have centrally positioned mount-receiving apertures 39 and 59, respectively, defined therethrough, and first display head 100 and second display head 120 have centrally positioned mount-receiving apertures 108 and 128, respectively. Distal end 82 of support member 80 supports first rotational head 20, second rotational head 40, first display member 100 and second display member 120 preferably on support pins 84*a* and 84*b,* respectively, (depicted in FIGS. 3, 4 and 5), wherein support pins 84*a* and 84*b* preferably extend through washers 130*a* and 130*b,* respectively, and washers 130*a* and 130*b* are positioned substantially within mount hardware receptacle 106 and 126, respectively. Support pins 84*a* and 84*b* preferably further extend through centrally positioned mount-receiving apertures 108 and 128, respectively, through generally triangular-shaped wing nuts 132*a* and 132*b,* respectively, through centrally positioned mount-receiving apertures 39 and 59, and into distal end 82 of support member 80. This preferred mounting configuration enables wind-actuated rotation of first rotational head 20 and second rotational head 40, preferably prevents rotation of first display head 100 and second display head 120 and preferably enables general rocking action of first display head 100 and second display head 120 in response to interaction of each scoop cavity 38 and 58 with each movement-generating member 102 and 122, thereby maximizing holographic display.

Preferably, support member 80 is generally elongated with base 86 providing window mount or bracket 88 for the removably secure fastening of wind-actuated novelty device 10 to a vehicle window or doorframe, wherein mount or bracket 88 is known within the art. Although window mount or bracket 88 is preferred for base 86 of support member 80, wind-actuated novelty device 10 could be manufactured without a bracket or mount, wherein wind-actuated novelty device 10 could be hand-held or support member 80 could be inserted into the ground.

Support member 80, first surfaces 24*a* and 44*a,* second surfaces 24*b* and 44*b,* and/or ports 28*a* and/or 28*b* and/or 48*a* and/or 48*b* preferably include visual effects such as, but not limited to, holographic images, reflective ornamentation, distinctive or glow-in-the-dark coloration, insignias, mascot depictions, licensed characters, patriotic colors, religious indicia, seasonal ornamentation, a coloration pattern designed to enhance visual rotational during rotation, and/or any combination thereof.

In an alternate embodiment, first rotational head 20 and/or second rotational head 40 could be formed from generally transparent material or could incorporate some transparent portions therein, wherein rotation of one rotational head could be visible through the other rotational head.

In an alternate embodiment, a rotational axis could extend from first rotational head 20, passing through a generally cylindrical support center, and extending to second rotational head 40, whereby first rotational head 20 and second rotational head 40 could cooperatively rotate and/or spin.

In an alternate embodiment, first rotational head 20 and second rotational head 40 could be configured to rotate in opposite directions.

Figure 6:
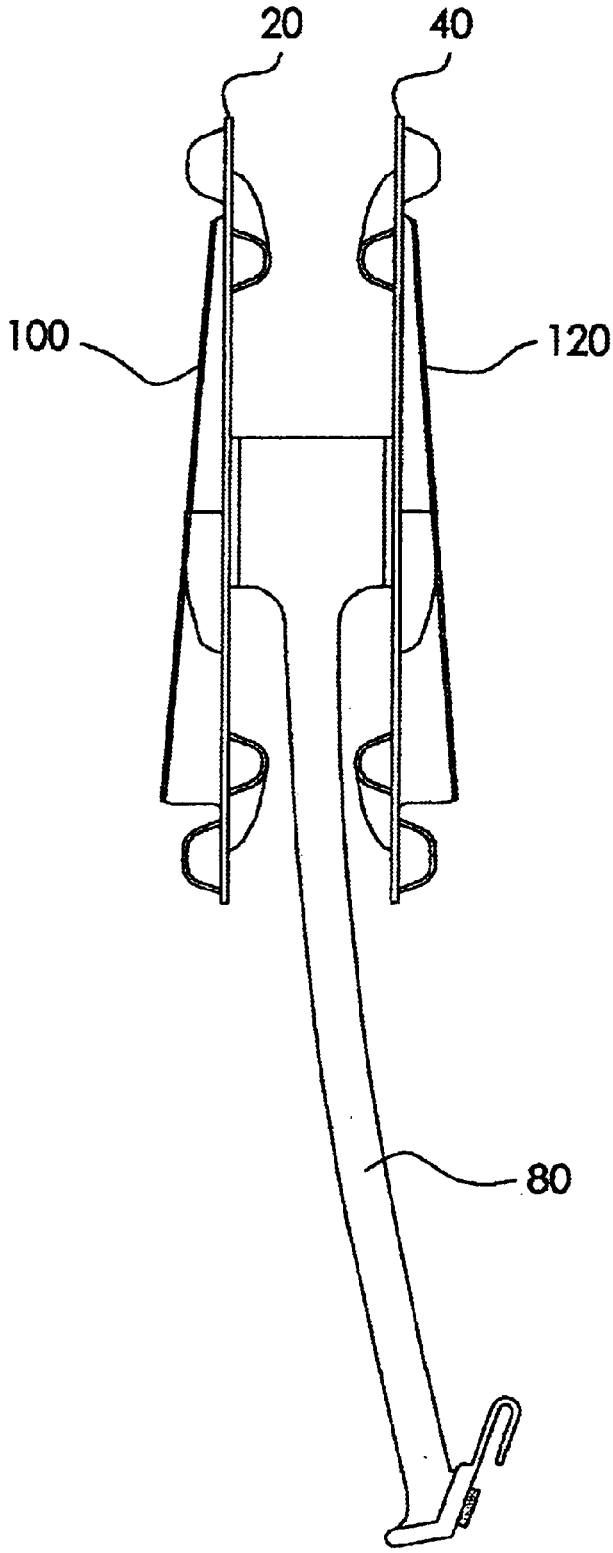
FIG. 6 is a side view of a wind-actuated novelty apparatus, according to an alternate embodiment of the present invention.

In an alternate embodiment, as depicted in FIG. 6, first rotational head 20 and second rotational head 40 could carry or be integrally formed with first display head 100 and second display head 120, respectively, wherein first display head 100 and second display head 120 could rotate with first rotational head 20 and second rotational head 40, respectively.

In an alternate embodiment, first rotational head 20 and/or second rotational head 40 could be pinwheel shaped.

In an alternate embodiment, wind-actuated audible effects may be incorporated into first rotational head 20 and/or second rotational head 40 to enable cheers, mascot vocals or musical tunes to accompany the visual rotational, wherein wind-actuated rotation of device 10 could activate an electronic sound synthesizer carried thereby to generate a mascot vocal, cheer, musical tune or any other desired audible rotational.

In an alternate embodiment, a motion activated audible effect sound synthesizer could be incorporated into wind-actuated rotational device 10 to enable cheers, mascot vocals or musical tunes to be initiated in response to motion detection to generate a mascot vocal, cheer, musical tune or any other desired audible rotational.

In an alternate embodiment, a sound synthesizer could be incorporated into wind-actuated rotational device 10, wherein such sound synthesizer could be battery, solar or electrically powered.

In an alternate embodiment, a sound emitting and recording device could be incorporated into wind-actuated rotational device 10, wherein a user could selectively record and audibly rotational a personalized message.

In an alternate embodiment, first rotational head 20 and/or second rotational head 40 could have more than one support member 80.

In an alternate embodiment, first rotational head 20 and/or second rotational head 40 could have only one plurality of air receiving and deflecting ports 28*a* and 48*a* or 28*b* and 48*b,* respectively, extending outwardly from either first surface 24*a* and 44*a* or second surface 24*b* and 44*b,* respectively.

In an alternate embodiment, each port of plurality of ports 28*a,* 28*b,* 48*a* and/or 48*b* could define any general shape such as, for exemplary purposes only, crescent shape, diamond shape, square or rectangular shape or a combination thereof.

In an alternate embodiment, support member 80 could be provided with a base to enable placement on antennae, positioning in soil, standing on pavement or any other generally horizontal surface, clipping or affixing to a chair, affixing to a hat or umbrella or any other type of rotational desired by an individual.

In an alternate embodiment, wind-actuated novelty device 10 could have illuminated rotational members or lights provided thereon, wherein such lights could be battery, solar, wind powered or could be provided with electrical connectors to enable plugging in to a common electrical outlet or a vehicle lighter adaptor.

In an alternate embodiment, wind-actuated novelty device 10 could include a rotation-generating motor, wherein such motor could be battery, solar, wind powered or could be provided with electrical connectors to enable plugging of the same into a common electrical outlet or a vehicle lighter adaptor.

In an alternate embodiment, wind-actuated novelty device 10 could be designed to enable removal and replacement of first display head 100 and/or second display head 120, wherein a user could interchange displays.

In an alternate embodiment, support member 80 could have two or more interlocking, telescoping or otherwise connecting members.

In an alternate embodiment, at least one surface 104*a* and/or 124*a* could have a fastening means such as, for exemplary purposes only, hook and loop fastener or adhesive, to enable removal, replacement and exchange of a variety of interchangeable display schemes.

In an alternate embodiment, the mount configuration described herein could be utilized for a wind-actuated novelty device having only one rotational head and/or only one display head.

In use, window mount or bracket 88 of base 86 of support member 80 is removably secured to a vehicle window or doorframe. While the vehicle is stationary, blowing wind passes through a plurality of air receiving and deflecting ports 28*a*, 28*b*, 48*a* and 48*b*, thereby generating rotational movement of first rotational head 20 and second rotational head 40, respectively. During vehicle operation, movement of wind-actuated rotational device 10 through the air enables similarly generated rotational movement. Rotational passage and interaction of scoop cavity 38 and 58 with movement-generating member 102 and 122 generates a rocking action of first display head 100 and second display head 120, thereby maximizing the display thereof.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A dual-head novelty device comprising:

a first rotational head, wherein said first rotational head is a generally flat, circular shaped disk with a first surface, a second surface and a plurality of air receiving and deflecting ports carried by at least one said surface;

a second rotational head, wherein said second rotational head is a generally flat, circular shaped disk with a first surface, a second surface and a plurality of air receiving and deflecting ports carried by at least one said surface;

at least one support member;

a first display member; and a second display member, wherein said first rotational head and said second rotational head are opposingly positioned relative to a first end of said support member and wherein said first display member is positioned proximate to said first rotational head and said second display member is positioned proximate to said second rotational head, wherein said first rotational head has a generally arcuate member carried by said first surface, said second rotational head has a generally arcuate member carried by said second surface, said first display member has a generally arcuate member carried by a first surface and said second display member has a generally arcuate member carried by a first surface, wherein interaction of said generally arcuate member of said first rotational head with said generally arcuate member of said first display member generates movement of said first display member, and wherein interaction of said generally arcuate member of said second rotational head with said generally arcuate member of said second display member generates movement of said second display member.

2. The dual-head novelty device of claim 1, further comprising a plurality of mounting means, wherein each said mounting means of said plurality of mounting means comprises an elongated pin, a washer, and a wing nut, wherein said wing nut has a generally pyramidal shape and a central aperture for said elongated pin, wherein said first display member and said second display member are generally circular-shaped, said first display member has a display receiving surface and said second display member has a display receiving surface, wherein said first display member and said second display member have a central aperture defined therethrough, said central aperture dimensioned to receive said elongated pin, wherein said first display member and said second display member have a washer receptacle centrally defined therein, wherein said first rotational head and said second rotation head have a central aperture defined therethrough, said central aperture dimensioned to receive said elongated pin, and wherein at least one pin receiving aperture is defined in said first end of said support member.

3. The dual-head novelty device of claim 2, wherein said display receiving surface carries mounting media to removably mount a display thereto.

4. The duel-head novelty device of claim 2, wherein said first display receiving surface and said second display receiving surface have coloration and indicia.

5. The dual-head novelty device of claim 4, wherein said indicia comprises a licensed logo or brand marking.

6. A wind-actuated spinning apparatus, comprising:

a first rotationally carried member having an outer surface and having a plurality of air receiving and deflecting inlets and outlets for wind-actuated rotation;

a second rotationally carried member having an outer surface and having a plurality of air receiving and deflecting inlets and outlets for wind-actuated rotation;

at least one support arm having a first end and a second end, wherein said first end carries said first and second rotationally-carried members in opposing positions and said second end carries a base mount;

a first display disc; and a second display disc, wherein said first display disc is positioned proximate to said outer surface of said first rotationally-carried member and said second display disc is positioned proximate to said outer surface of said second rotationally-carried member.

7. The wind-actuated spinning apparatus of claim 6, further comprising a first elongated fastener and a first fastener securing member for securing said first rotationally-carried member and said first display disc to said first end of said support arm, and a second elongated fastener and a second fastener securing member for securing said second rotationally-carried member and said second display disc to said first end of said support arm.

8. The wind-actuated spinning apparatus of claim 6, wherein said lateral movement of said first display disc and said second display disc is enabled relative to said support arm and wherein said first display disc and said second display disc are rotationally fixed.

9. A method of wind-actuated, dual-head rotational display comprising the steps of:

a) obtaining a wind-actuated rotational device with a support member, a pair of rotational members, each having a plurality of air receiving and deflecting ports, said plurality of air receiving and deflecting ports enabling wind-actuated rotation of each said rotational member, and a device base support, said device base support enabling removable placement of said wind-actuated, dual-head rotational display on a vehicle;

b) placing said wind-actuated, dual-head rotational display on a vehicle;

c) enabling wind-actuation of each said rotational member by collection of moving air.

* * * * *